United States Patent [19]

Starling et al.

[11] Patent Number: 4,573,603

[45] Date of Patent: Mar. 4, 1986

[54] FLUID CONTAINER

[75] Inventors: Jeffrey T. Starling, Westerville, Ohio; Bruce D. Jones, Lake Mary, Fla.

[73] Assignee: Worthington Industries, Inc., Columbus, Ohio

[21] Appl. No.: 740,548

[22] Filed: Jun. 3, 1985

[51] Int. Cl.[4] ..... B65D 7/42

[52] U.S. Cl. ..... 220/5 R; 220/69; 206/509

[58] Field of Search ..... 220/5 R, 69, 71, 85 P; 206/509, 51 X

[56] References Cited

U.S. PATENT DOCUMENTS

| | | | |
|---|---|---|---|
| D. 239,505 | 4/1976 | Ward . | |
| D. 277,041 | 1/1985 | Nichols . | |
| 2,124,565 | 7/1938 | Goll et al. . | |
| 2,983,403 | 5/1961 | Mauser . | |
| 3,294,271 | 12/1966 | Armbruster | 220/5 R |
| 3,355,049 | 11/1967 | Nolan | 220/5 R |
| 3,447,716 | 6/1969 | Nesse | 206/509 |
| 3,825,145 | 7/1974 | Reynolds . | |
| 3,827,595 | 8/1974 | Reynolds . | |
| 4,264,016 | 4/1981 | Speas | 220/5 R X |
| 4,282,974 | 8/1981 | Quandel . | |
| 4,372,458 | 2/1983 | Carlson | 220/5 R X |
| 4,402,451 | 9/1983 | Woerz et al. | 206/509 X |
| 4,482,067 | 11/1984 | Saito et al. | 206/509 X |

FOREIGN PATENT DOCUMENTS

| | | | |
|---|---|---|---|
| 1007595 | 10/1965 | United Kingdom . | |
| 1127305 | 9/1968 | United Kingdom | 220/5 R |

*Primary Examiner*—Steven M. Pollard

*Attorney, Agent, or Firm*—Fay, Sharpe, Fagan, Minnich & McKee

[57] ABSTRACT

A container for fluid products includes an inner shell of sheet metal which has a substantially cylindrical body and top and bottom end walls. A first resilient outer member encases the inner shell bottom end wall and forms a base portion for the container. The first member includes a substantially cylindrical side wall portion and a base portion which, in turn, includes a ring section, provided on its outer surface with a pair of spaced ribs, as well as a recessed inner section. A second resilient outer member encases the inner shell top end wall and forms a top portion for the container. The second member includes a substantially cylindrical side wall portion and a top portion including a ring section, having a planar outer surface, and a recessed inner section. The ring section has a suitable diameter and is sized to fit between the first portion spaced pair of ribs to permit stacking of the container.

20 Claims, 3 Drawing Figures

FIG. 1
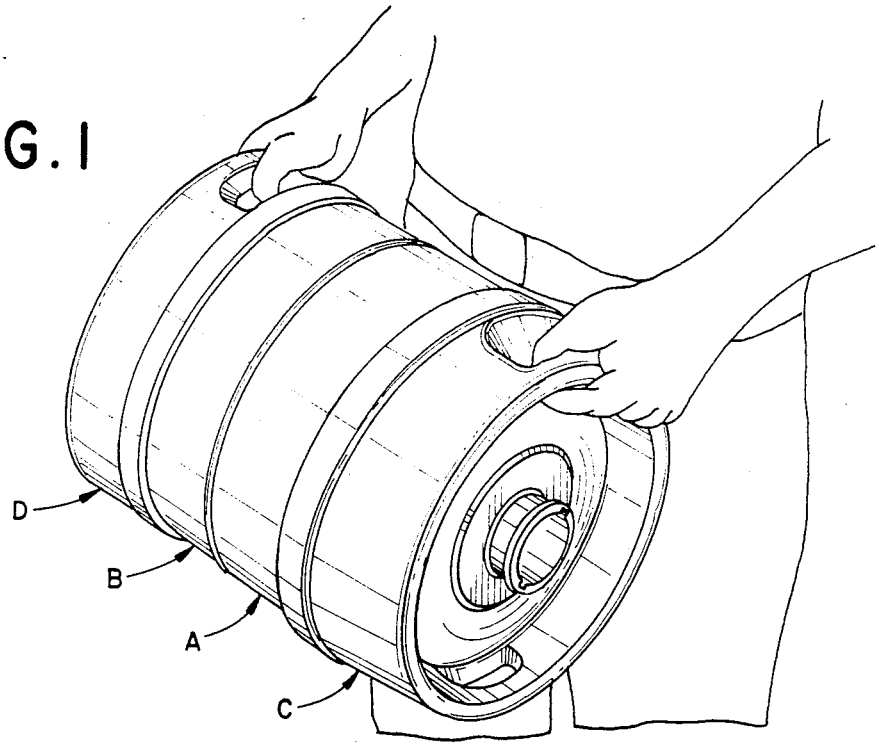
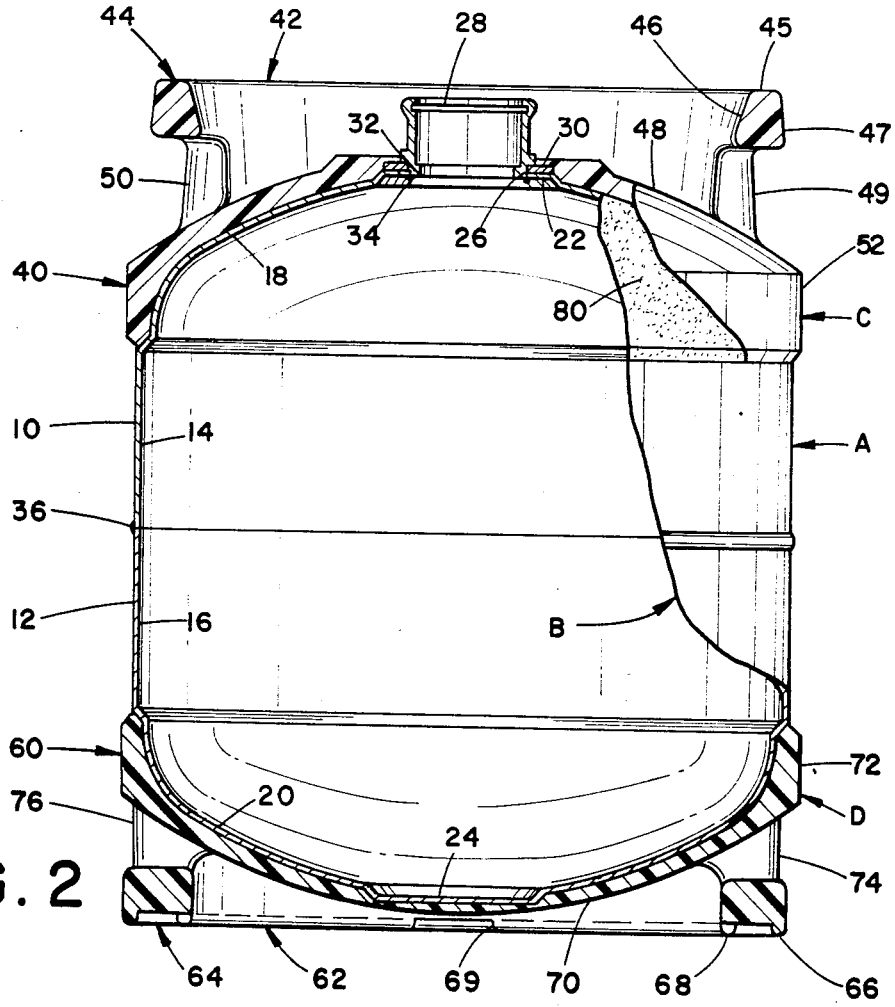
FIG. 2

FLUID CONTAINER

BACKGROUND OF THE INVENTION

This invention generally pertains to fluid containers. More specifically, the present invention relates to a metal barrel, the ends of which are encased in a plastic material which is shaped to provide cooperating stacking rings.

The invention is particularly applicable to beer kegs and will be described with particular reference thereto. However, it will be appreciated by those skilled in the art that the invention has broader applications and may also be adapted for use in containers or vessels for storing and shipping other beverages, as well as assorted fluids, such as chemicals, paints, and the like.

Heretofore, most conventional beer kegs were made entirely out of a metal, such as aluminum or steel. These kegs were generally provided with openings in the side and top walls in which a filler plug and a tapper plug were respectively mounted. Metal kegs are, however, heavy, and therefore difficult to handle, dent fairly easily and are noisy in handling. Moreover, it is expensive to shape the metal to produce suitable stacking surfaces on metal kegs.

More recently, a beer keg made entirely of plastic has become known. Such a keg, however, has its own problems in that the walls thereof must be fairly thick in order to be strong enough to stand up to everyday usage and this makes the keg fairly heavy. Also, a plastic keg is more prone to cracking at the low storage temperature of beer than is a metal keg and it does not cool down as quickly as a metal keg. Moreover, most types of plastic are not capable of storing carbonated liquids, such as beer, under pressure.

Another type of beer keg which has recently come into use includes a metal barrel which is completely enclosed by a plastic coating. As even more recent type of keg provides a metal barrel, only the ends of which are encased in a plastic material. There are, however, disadvantages to both of the plastic/metal kegs mentioned above in that they do not have stable stacking surfaces, and also in that they are not easy to handle since they do not have suitable handle apertures on both the top and bottom ends of the keg to allow the keg to be readily lifted sideways. Prior art plastic/metal kegs also are not made of a plastic material which adequately cushions shocks to the keg.

Accordingly, it has been considered desirable to develop a new and improved fluid container wich would overcome the foregoing difficulties and others while providing better and more advantageous overall results.

BRIEF SUMMARY OF THE INVENTION

In accordance with the present invention, a new and improved container is provided for fluid products.

More particularly in accordance with the invention, the container comprises an inner shell of sheet metal which includes a substantially cylindrical body and top and bottom end walls therefor. A first resilient outer member encases the inner shell bottom end wall and forms a base portion for the shell. The first member includes a substantially cylindrical side wall portion and a base portion. The base portion includes a ring section, provided on its outer surface with a pair of spaced ribs, as well as a recessed inner section. A second resilient outer member encases the inner shell top end wall and forms a top portion for the shell. The second member includes a substantially cylindrical side wall portion and a top portion including a ring section and a recessed inner section. The ring section has a planar outer surface which is of a suitable width so that it is sized to fit between the first portion spaced pair of ribs to permit stacking of the container.

In accordance with another aspect of the invention, the container further comprises a first pair of handles defined by apertures provided in the first member side wall portion and a second pair of handles defined by apertures provided in the second member side wall portion whereby the container can be lifted by grasping any two of the handles.

According to another aspect of the invention, the container further comprises a first rolling ring integral with the first member and extending radially outwardly from the side wall portion thereof and a second rolling ring integral with the second member and extending radially outwardly from the side wall portion thereof.

According to a further aspect of the invention, the container further comprises a tap fitting means extending outwardly from the inner shell top end wall. The second member top portion recessed inner section extends around the tap fitting means which comprises a spud portion and a reinforcing ring which encircles the spud.

In accordance with a still further aspect of the invention, the inner shell includes first and second halves which are secured to each other.

According to still another aspect of the invention, the inner shell is made of a corrosion resistant steel and has a thickness of approximately 0.036 inches.

In accordance with yet another aspect of the invention, the first and second outer members are made of a plastic material. Preferably, the plastic material is a polyurethane which has a foam interior and a smooth exterior.

According to yet still another aspect of the invention the plastic material has a flexural modulus of between 15 and 21 (103.42 and 144.79) Kpsi ($MN/m^2$), a tensile strength of between 1.5 and 2.2 (10.34 and 15.17) Kpsi ($MN/m^2$) and an elongation capacity of between 200 and 230%.

One advantage of the present invention is the provision of a container for fluid products which has suitably configured stacking surfaces so that a plurality of containers can be stacked in a way that the stack remains stable.

Another advantage of the invention is the provision of a container which is provided with handle apertures at both ends so that the container can be easily lifted and carried.

Still another advantage of the invention is the provision of a container which is provided with plastic end portions which are so shaped that they provide sturdy stacking edges as well as rolling rings and handle apertures for the container.

Yet another advantage of the present invention is the provision of a container which is easy to cool down since it has an exposed metal central section.

Yet still another advantage of the present invention is the provision of a metal container having resilient plastic end portions which absorb shocks to the ends of the metal container as it is moved or stacked to prevent the denting thereof.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 1 is a perspective view of the beer keg according to the present invention;

FIG. 2 is an enlarged side elevational view, in partial cross section, of the beer keg of FIG. 1; and, FIG. 3 is an enlarged side elevational view, in partial cross section, of a plurality of beer kegs according to FIG. 1 in a stacked relationship.

DETAILED DESCRIPTION OF THE PREFERRED EMBODIMENT

Figure 3:
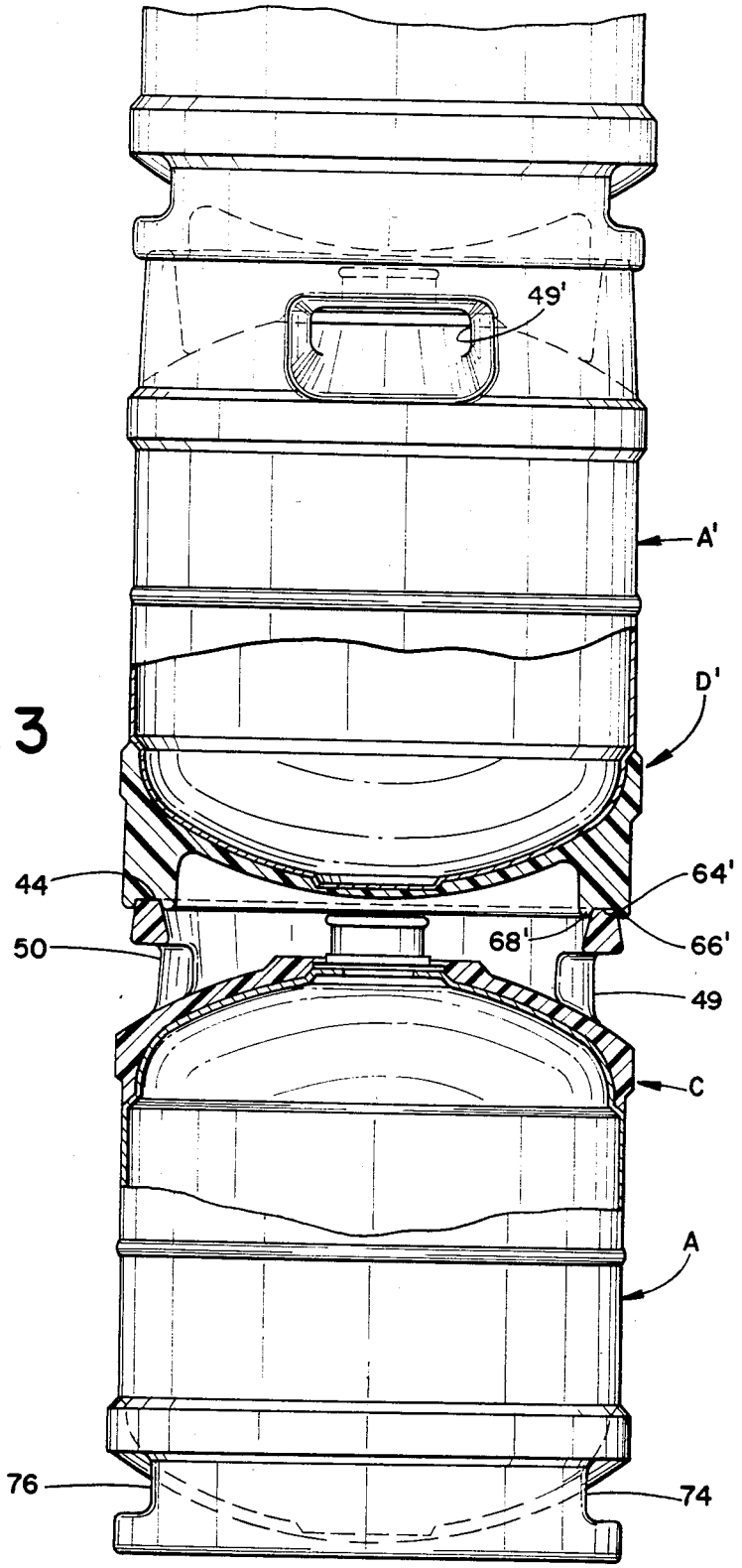

Referring now to the drawings, wherein the showings are for purposes of illustrating a preferred embodiment of the invention only and not for purposes of limiting same, FIG. 1 shows the subject new container A. While the container is primarily designed for use as, and will hereinafter be described as, a beer keg, it will be appreciated that the overall inventive concept could be adapted for use in other fluid storage environments as well.

With reference now also to FIG. 2, the container A includes a shell B as well as a top member or collar C and a base member or foot ring D. The shell B includes a body first half 10 and a body second half 12. Each body half 10, 12 includes a respective cylindrical side portion 14, 16 as well as an arced or convex end portion 18, 20. Provided at the apex of each end portion is a respective flat plate member 22, 24. An aperture or bung socket 26 is provided in the top flat plate 22 and a spud or tap fitting 28 is inserted therein. A reinforcing ring 30 encircles the spud 28 and is provided underneath a flange 32 of the spud to reinforce the spud in the opening 26. The spud or fitting 28 can be secured to the shell B by, for example, a weld bead 34. Similarly, a weld bead 36 can secure the body top and bottom halves 10, 12 to each other. Of course, other suitable conventional means of securing the tap fitting to the body top half and the body halves to each other could also be provided.

The collar member C includes a cylindrical side portion 40 as well as an end portion 42. The end portion includes a substantially circular ring section 44 having a flat top surface 45 and a pair of upwardly tapered side walls 46, 47. It should be noted that the cylindrical side portion 40 is preferably tapered upwardly somewhat as a whole, as may be more evident from FIGS. 1 and 3. Enclosed by the ring section 44 is a recessed inner section 48. Also included on the collar is a pair of apertures 49, 50 which are disposed substantially opposite each other and which define handles for lifting the container A. Integral with the cylindrical side portion 40 is a rolling ring 52 which extends radially outwardly from the cylindrical side portion and provides a raised surface on which the container A can be rolled on its side.

The foot ring member D also includes a cylindrical side portion 60 as well as an end portion 62. The end portion 62 is provided with a substantially circular ring section 64 which includes first and second radially spaced concentric rib members 66, 68. The facing sides of the two rib members 66, 68 are slightly tapered to cooperate with the tapered side walls of an adjacent keg top member ring section thereby providing a sturdy interlocking relationship as shown in FIG. 3. The inner, or smaller diameter, rib member 68 can be discontinuous if desired by having gaps 69 therein, as shown in FIG. 2. A recessed inner portion 70 is enclosed by the ring section 64. A rolling ring 72 is integral with the cylindrical side portion 60 and extends radially outwardly therefrom to provide a second rolling surface for the container A when it is rolled on its side. Also included in the foot ring are a pair of apertures 74, 76 which define another pair of handles for lifting the container A.

Since handle apertures 49, 50 and 74, 76 are defined in both the collar C and the foot ring D, it becomes possible to lift the keg through the use of any two of the apertures. For example, as illustrated in FIG. 1, it becomes possible to carry the barrel using one top and one bottom handle aperture. This way of carrying the barrel is especially advantageous when it is full. Carried by the use of only the two collar handle apertures 49, 50, a keg's foot ring section D would be adjacent a person's knees making the keg awkward to carry. But carrying the keg so that its foot ring section is higher than one's knees is difficult to do when the keg is full since it may weigh on the order of 45 (20.41) pounds (Kg). Thus, it is advantageous to provide handle defining apertures 74, 76 in the foot ring as well to enable a person to carry a full keg sideways as shown in FIG. 1. As is evident from this FIGURE, the handle apertures 49, 50 and 74, 76 are appropriately sized so that a person's fingers can extend therethrough to enable a person to get a firm grip on the container A.

The four handle openings or apertures 49, 50 and 74, 76 also serve as weep holes for the container A to allow any fluid which may be trapped in the recessed inner portions 48, 70 of the collar C and foot ring D to flow out. Any fluid trapped between the concentric ribs 66, 68 of the base member ring section 64 can flow into the recessed inner portion 70 through one of the gaps or discontinuities 69 provided in the inner rib 68.

With reference now also to FIG. 3, a plurality of identical kegs or containers are illustrated in a stacked configuration. In order to avoid confusion, a second container will have its components identified by like numerals with a primed (') suffix.

It is evident that the collar ring 44 of the first container A is suitably situated and sized so that it fits between first and second rib members 66', 68' on a ring section 64' of an adjacent second container's A' foot ring D'. This enables the second container A' to be stacked on top of the first container A. With the stacking feature of the present invention, it becomes feasible to stack approximately six containers on top of each other in a very stable structure since the two rib portions 66', 68' of the second container A' adequately trap the collar ring portion 44 of the first container A.

This stability is enhanced by the tapered surfaces provided on the mating edges of the ribs 66', 68' and the ring 44. As mentioned, the facing surfaces of the ribs 66', 68' are tapered in a direction away from the second container A' and correspondingly, the ring 44 on the collar C is also tapered in a direction away from the first container A. This makes for a tight fit between the foot ring 64' and the collar ring 44 so that a sturdy connecting structure is provided between each of the kegs which are positioned on top of one another.

In the preferred embodiment, the container has an outside diameter, including the foot ring and collar of 12 9/16 (319) inches (millimeters) and a height of 15 (381) inches (mm.). The collar ring section 44 is approximately $\frac{5}{8}$ (16) inches (mm.) wide at its top surface 45 and has an inner diameter of approximately 10 7/16 (265) inches (mm.). Correspondingly, the gap between the concentric ribs 66, 68, approximately halfway down the tapered facing surfaces, is approximately $\frac{3}{4}$ (19.5) inches (mm.) and the inner rib 68 has an inside diameter of 10 5/12 (262) inches (mm.). Also, the ribs 66, 68 can be approximately $\frac{1}{4}$ (6.4) inch (mm.) high.

The rolling ribs or rings 52 and 72 can extend outwardly approximately $\frac{1}{8}$ (3.2) inch (mm.) from the rest of the respective cylindrical side portions 40, 60.

Preferably, the major diameter of the cylinder is twice its minor diameter so that it has an approximately 2:1 head ratio. This geometry is advantageous since it enables a container to bear great internal pressures and the container of the present invention can be rated up to 240 (0.17) psi ($MN/m^2$ - meganewtons per square meter). Preferably, the keg holds approximately 5.16 (19.53) gallons (liters).

In one preferred embodiment, the container B can be made of a corrosion resistant stainless steel, while the collar C and the foot ring D can be made of a suitable plastic, such as reaction injected molded polyurethane foam. Of course, other plastic materials could also be used for the end portions.

However, a semirigid polyurethane foam has been found advantageous as the plastic used for the collar C and the foot ring D, since it provides excellent resistance to damage caused by drops during handling, whether the keg is full or empty and whether the keg is dropped straight or at an angle. In one preferred embodiment, the polyurethane plastic can be made from a mixture of polyether polyol, a suitable polyisocyanate and several additives sold under the trade name SPECTRIM 15 by the Dow Chemical Corporation. This polyurethane has a flexural modulus of between 15–21 (103.42–144.79) Kpsi ($MN/m^2$—meganewtons per square meter), a tensile strength of between 1.5–2.2 (10.34–15.17) Kpsi ($MN/m^2$), an elongation capacity of between 200–230% and a tear strength of between 250–340 pli pounds per linear inch. It is evident that other plastics having these physical properties could also be used instead of polyurethane for the end portions.

After extensive testing, minimal fracture of the polyurethane skirts, that is, the collars and foot rings, has been found. It should be noted that a number of kegs have gone through over 100 drops without major dimensional changes in the kegs.

Also, the polyurethane used for the plastic end portions of the present invention has a foam interior and a smooth exterior. This material is not as slick as the plastic used in conventional plastic encased barrels and therefore the container A of the present invention is easier to pick up without having it slip from one's hands.

It is also evident that the cooperating stacking surfaces of the present invention are considerably more easily formed from a plastic material than from a metal. Similarly, the handle apertures and rolling rings are also more easily formed from plastic than from metal.

The present invention is illustrated as having a single opening in the container A, i.e. the tap fitting, including the spud 28 and the reinforcing ring 30, which is adapted to utilize a conventional valve means (not illustrated) to control the entry and outflow of a pressurized fluid. It should, however, be recognized that separate filling and emptying openings may also be provided in the container A if that is thought desirable.

One process for manufacturing a keg according to the present invention, includes suitable manufacturing steps for forming the shell or body halves 10, 12, such as deep drawing. The tap fitting can be installed in and secured to the top shell half after a suitably sized aperture 26 is formed therein. After this, the shell halves 10, 12 can be secured to each other. The respective end portions 18, 20 can then be coated with a suitable conventional adhesive 80 (see FIG. 2) before the collar and foot ring C, D are injection molded thereon to form the container A. Of course, other suitable securing means for the collar C and foot ring D to the shell B may also be used.

The subject invention thus provides a stackable container which has mating adjacent edges for a very solid and sturdy stacking configuration so that up to six containers may be positioned on top of each other without fear of damage to the containers or fear of creating an unsteady stack. Also, the invention includes a container which is provided with handle apertures at both ends so that it can be comfortably lifted and carried. To further enhance movement of the container, it is also provided with a pair of rolling rings so that the container can be rolled on its side, which is especially advantageous when the container is filled. Preferably, the collar and foot ring of the container are made of a suitable plastic material which has good shock absorbency characteristics and suffers minimal cracking problems even in prolonged use.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A container for fluid products comprising:

an inner shell of sheet metal which includes a substantially cylindrical body and top and bottom end walls;

a first resilient outer member encasing said inner shell bottom end wall and forming a base portion for the container, said first member including a substantially cylindrical side wall portion and a base portion, said base portion including a ring section, provided on its outer surface with a pair of spaced ribs, and a recessed inner section; and, a second resilient outer member encasing said inner shell top end wall and forming a top portion for the container, said second member including a substantially cylindrical side wall portion and a top portion including a ring section, having a planar outer surface, and a recessed inner section, said second member ring section having a suitable width so that it is sized to fit between said first portion spaced pair of ribs to permit stacking of the container.

2. The container of claim 1 further comprising:

a first pair of handles defined by apertures provided in said first member side wall portion; and, a second pair of handles defined by apertures provided in said second member side wall portion whereby said container can be lifted by grasping any two of said handles.

3. The container of claim 1 further comprising:

a first rolling ring integral with said first member and extending radially outwardly from said side wall portion thereof; and, a second rolling ring integral with said second member and extending radially outwardly from said side wall portion thereof.

4. The container of claim 1 further comprising a tap fitting means extending outwardly from said inner shell top end wall, said second member top portion recessed inner section extending around said tap fitting means.

5. The container of claim 4 wherein said tap fitting means comprises a spud portion and a reinforcing ring encircling said spud portion.

6. The container of claim 1 wherein said inner shell includes first and second halves which are secured to each other.

7. The container of claim 1 wherein said inner shell is made of a corrosion resistant steel and said first and second outer members are made of a plastic material.

8. The container of claim 7 wherein said plastic material is polyurethane which has a foam interior and a smooth exterior.

9. The container of claim 7 wherein said plastic material has a flexural modulus of between 15 and 21 (103.42 and 144.79) Kpsi ($MN/m^2$), a tensile strength of between 1.5 and 2.2 (10.34 and 15.17) Kpsi ($MN/m^2$) and an elongation capacitor of between 200 and 230%.

10. A stackable barrel for fluid products comprising:

a single wall metal shell having a substantially cylindrical body and top and bottom end walls which have a convex shape;

an external base member made of a resilient material and secured to said bottom end wall, said base member including a substantially cylindrical side wall portion and a base portion including a ring section and a recessed inner section, said ring section being provided with a pair of concentric spaced ribs at its outer surface;

an external top member made of a resilient material and secured to said top end wall, said top member including a substantially cylindrical side wall portion and a top portion including a ring section having a planar top surface, said top member ring section top surface being sized to be of a width less than the distance between said base member pair of spaced ribs to permit stacking; and, handle means for lifting the barrel, said handle means including at least one first handle defined by a handle aperture provided in said base member, and at least one second handle defined by a handle aperture provided in said top member.

11. The barrel of claim 10 further comprising a pair of rolling rings, one being integral with each of said base and top members and extending radially outwardly therefrom.

12. The barrel of claim 10 further comprising a tap fitting including a spud member extending transversely outward from said metal shell top end wall.

13. The barrel of claim 12 further comprising a reinforcing ring encircling said spud member and adjacent to said metal shell top end wall.

14. The barrel of claim 10 wherein said metal shell is made of steel and said base and top members are made of plastic.

15. A stackable beer keg comprising:

a single wall metal barrel having a substantially cylindrical side wall and top and bottom end walls;

a foot ring including a substantially cylindrical side wall portion and a base portion including a ring section and a recessed inner section, said ring section being provided with a pair of concentric spaced tapered ribs along its outer surface;

a collar including a substantially cylindrical side wall portion and a top portion including a tapered ring section, a free end of said ring section being suitably sized to fit between said base portion spaced ribs to permit stacking;

securing means for securing said foot ring to an exterior surface of said barrel bottom end wall and said collar to an exterior surface of said barrel top end wall, respectively; and, a plurality of handles defined on the keg to permit lifting thereof, said handles including a first pair of opposed handles defined on said foot ring and a second pair of opposed handles defined on said collar, said foot ring and collar being made of a plastic material which is shock absorbent to resist damage caused by drops during handling.

16. The beer keg of claim 15 further comprising a pair of rolling rings, one being integral with each of said collar and foot ring cylindrical side wall portions and extending radially outward therefrom by approximately $\frac{1}{8}$ inch.

17. The beer keg of claim 15 further comprising a tap fitting including a spud member extending transversely outward from said barrel top wall and a reinforcing ring.

18. The beer keg of claim 15 wherein said metal barrel includes top and bottom halves which are welded to each other.

19. The beer keg of claim 15 wherein said metal barrel is made from corrosion resistant steel and said collar and foot ring are made from polyurethane which has a foam interior and a smooth exterior.

20. The beer keg of claim 15 wherein said securing means includes an adhesive coating provided on said top and bottom end walls before said collar and foot ring are molded thereon.

* * * * *